United States Patent [19]

Theurer et al.

[11] Patent Number: 4,461,604

[45] Date of Patent: Jul. 24, 1984

[54] MOBILE MACHINE FOR REMOVING SURFACE IRREGULARITIES FROM RAIL HEADS

[75] Inventors: Josef Theurer; Klaus Riessberger, both of Vienna, Austria

[73] Assignee: Franz Plasser Bahnbaumaschinen-Industriegesellschaft m.b.H., Vienna, Austria

[21] Appl. No.: 261,949

[22] Filed: May 8, 1981

Related U.S. Application Data

[62] Division of Ser. No. 7,424, Jan. 29, 1979, Pat. No. 4,309,846.

[30] Foreign Application Priority Data

Feb. 10, 1978 [AT] Austria ..... 978/78

[51] Int. Cl.[3] ..... B23D 1/20; E01B 31/15

[52] U.S. Cl. ..... 409/296; 409/298; 409/319; 51/5 B; 51/178

[58] Field of Search ..... 51/178, 5 R, 5 B, 241 LG; 409/178, 180, 296–297, 298, 300, 319, 337; 29/33 A; 144/133 B

[56] References Cited

U.S. PATENT DOCUMENTS 1,025,754 5/1912 Little ..... 409/319 X
2,791,071 5/1957 Schorling et al. ..... 51/178

FOREIGN PATENT DOCUMENTS 870346 12/1941 France ..... 144/133 B

*Primary Examiner*—Frederick R. Schmidt
*Assistant Examiner*—Debra S. Meislin
*Attorney, Agent, or Firm*—Kurt Kelman

[57] ABSTRACT

A mobile rail head planing machine comprises a pair of tool carriers vertically adjustably mounted on a machine frame, respective ones of the carriers being associated with a respective track rail. Each tool carrier carries a metal shearing tool engaging with the lateral outside face of the rail head of the respective rail and guide rollers respectively engaging the running faces and lateral outside faces of the rail heads guide each tool carrier along the respective rail. Power-actuated jacks press the guide rollers against the rail head faces they engage for guiding each tool carrier clearance-free along the rails.

3 Claims, 6 Drawing Figures

MOBILE MACHINE FOR REMOVING SURFACE IRREGULARITIES FROM RAIL HEADS

Figure 1:
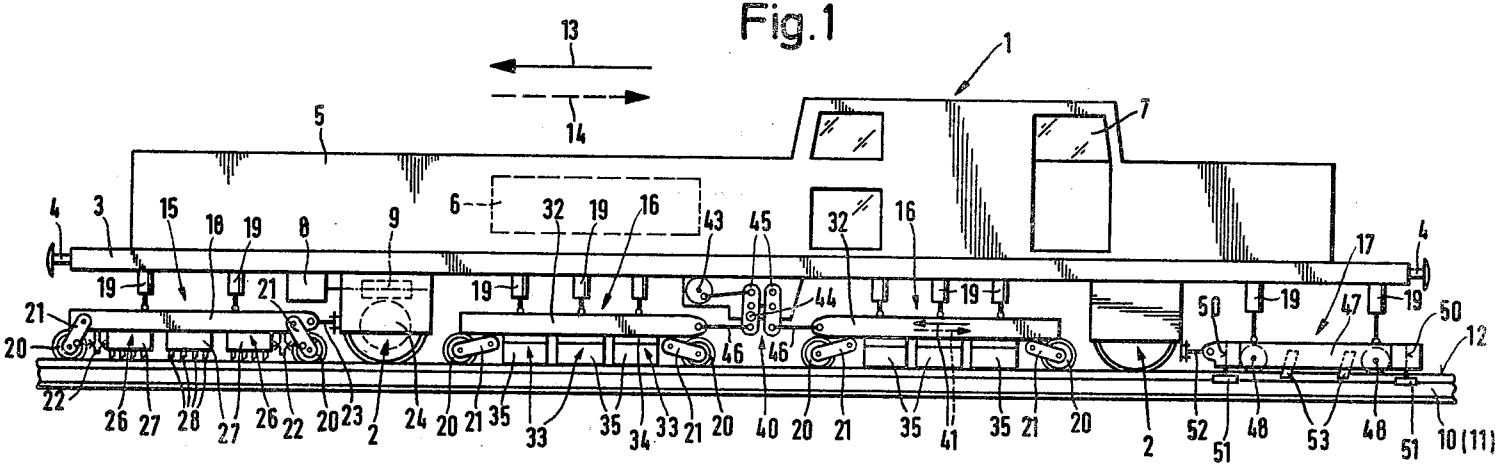

This is a division of our copending application Ser. No. 7424, filed Jan. 29, 1979, now U.S. Pat. No. 4,309,846.

The present invention relates to improvements in a mobile machine mounted on a track for advancement therealong, the track comprising two rails each including a head having a running face, a lateral inside face and a lateral outside face, and more particularly to a machine of this type designed for removing overflow metal from the lateral outside faces of the rails.

U.S. Pat. No. 4,050,196, dated Sept. 27, 1977, discloses a rail grinding machine with three successively mounted grinding modules mounted on a machine frame which advances along the track. Each grinding module may comprise a frame running on the track rails on flanged wheels which may be pressed without play against the inside faces of the rails for centering the module regardless of the track gauge. If desired, the module may consist of a two-part frame which is centered in this manner so that the grinding tools mounted on the module may always be in an accurate operating position.

U.S. Pat. No. 3,707,808, Jan. 2, 1973, discloses a mobile rail grinder with two grinding modules running on flanged wheels on a track rails and being transversely aligned at a constant distance. The two modules are connected by rods through ball joints to facilitate working in curves but if the track gauge changes, an unctrollable play will occur between the flanged wheels and the rails, which will have a highly deleterious effect on the grinding of the rails by the whetstones mounted on each grinding module.

Austrian Pat. No. 221,131, published May 10, 1962, discloses a rail grinding machine wherein abrasive bands are pressed into contact with the running faces of the rail heads and the slides carrying the abrasive bands are interconnected by jacks for changing the transverse distance between the slides.

It is the primary object of this invention to provide a mobile machine for removing surface irregularities from the faces of rail heads, and more particular overflow metal from the lateral outside faces of field sides of the rail heads, wherein the exact and constant engagement of metal shearing tools mounted on the tool carriers for engagement with the lateral outside face of the rail head is always assured, regardless of the track gauge.

In accordance with the invention, this object is accomplished in a mobile machine which comprises a machine frame and a pair of vertically adjustable tool carriers, a respective carrier being associated with a respective rail. Each tool carrier carries a metal shearing tool engaging with the lateral outside face of the rail head of the respective rail and guide rollers respectively engaging the running faces and lateral outside faces of the rail heads for guiding each tool carrier along the respective rail. Power-actuated means press the guide rollers against the rail head faces they engage for guiding each tool carrier clearance-free along the rails.

Compared to tool carriers guided along the rails by flanged wheels, this arrangement has the considerable advantage that the rail head surface deformations due to different wear of the rails along their extension will not cause different engagement conditions between the guide wheel and the rail and a corresponding lateral displacement of the guide wheel or roller with respect to the axis of the track. Thus, the two separate guide rollers for the tool carriers of the invention always assure centering of the carrier as long as the guide rollers are engaged with rail head surface areas which are not worn, which are present even in heavily worn track rails. This, in turn, will assure the proper engagement of the metal shearing tools with the rail head.

Figure 2:
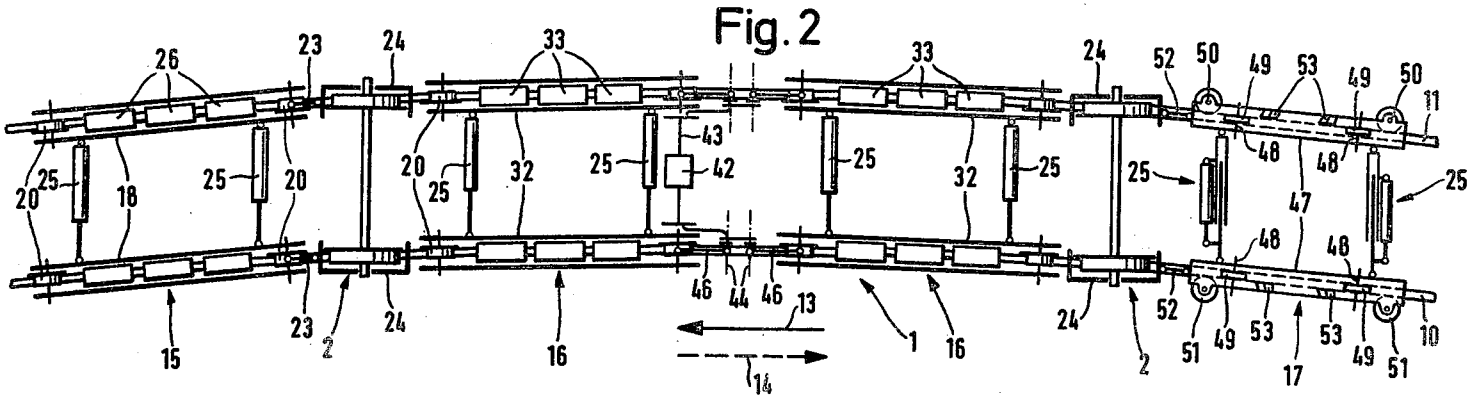
Figures 3, 4, 5, 6:
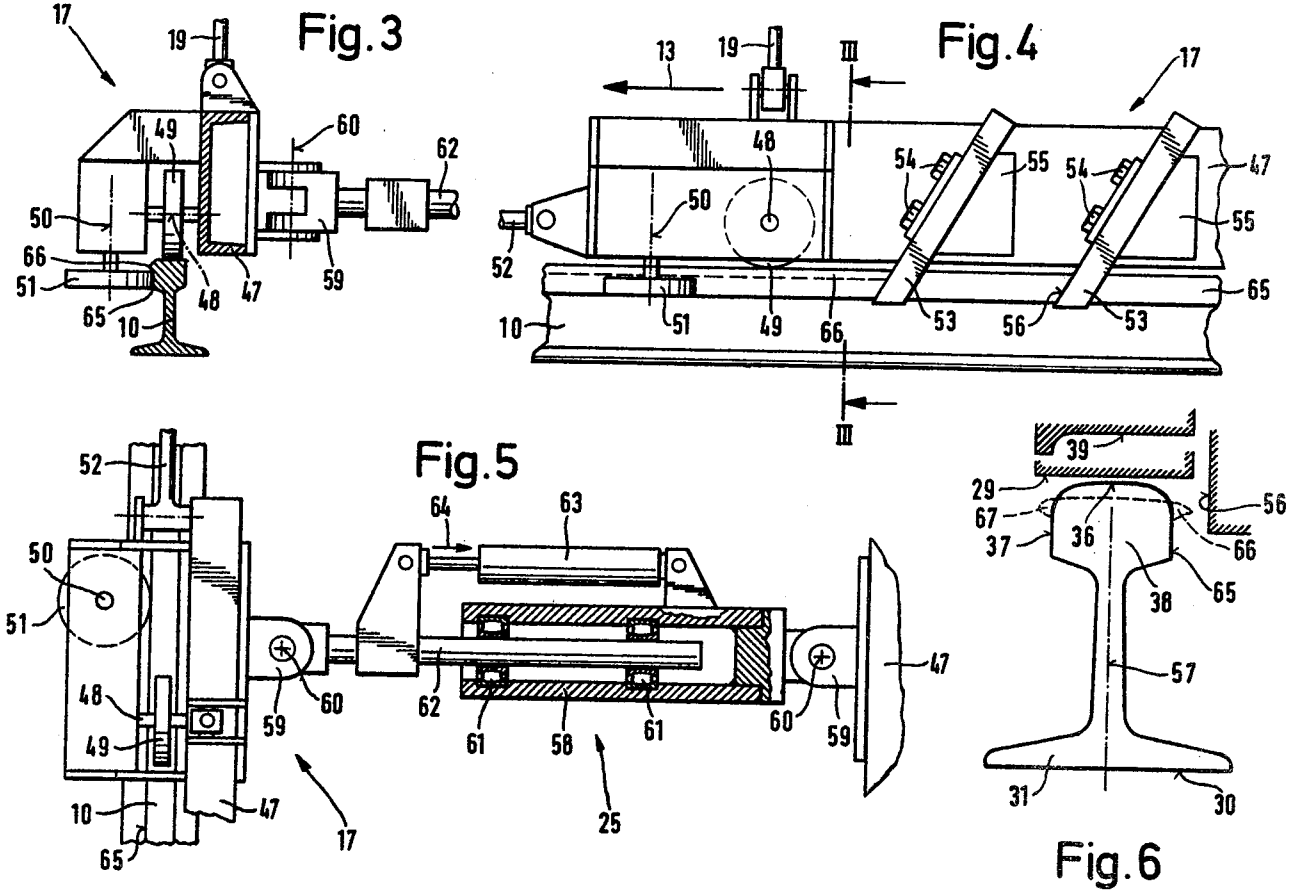

The above and other objects, advantages and features of the invention will become more apparent from the following detailed description of a now preferred embodiment thereof, taken in conjunction with the accompanying schematic drawing wherein FIG. 1 is a side elevational view of a mobile machine provided with a succession of tool carriers with different rail surfacing tools, including tool carriers with metal shearing tools according to this invention, FIG. 2 is a schematic top view illustrating the arrangement of the tool carriers, FIG. 3 is an enlarged sectional view along line III—III of FIG. 4, showing a detail of the set of tool carriers according to the present invention, FIG. 4 is a partial side elevational view thereof, FIG. 5 is a top view, partly in section, of the detail illustrated in FIGS. 3 and 4, and FIG. 6 is a schematic illustration of a rail and the operation of the machine in relation thereto.

Referring now to the drawing and first to FIGS. 1 and 2, there is shown a mobile machine 1 comprising machine frame 3 comprising two undercarriages 2, 2 supporting the machine frame for advancement of machine 1 along the track in an operating direction indicated by arrow 13 or a reverse direction indicated by arrow 14. Couplings 4 at respective ends of machine frame 3 enable the machine to be incorporated as a car in a work train. Closed housing 5 is mounted on the machine frame and includes operator's cab 7, a power plant 6 being arranged in the housing to supply power to the operating tools and mechanisms of the machine, including its drive 9 connected to the power plant by transmission 8 to make the machine self-propelled. The machine moves on track 12 comprising two rails 10 and 11 each including rail head 38 having running face 36, lateral inside face or gauge side 37 and lateral outside face or field side 65, as shown in FIG. 6.

In the illustrated embodiment, three sets 15, 16 and 17 or different metal removing devices are mounted on machine frame 3 for removing surface irregularities from the faces of the rail heads. Each set comprises at least one pair of tool carriers substantially transversely aligned with respect to the track and a respective ones of the tool carriers being associated with a respective rail 10 and 11. Each of the tool carriers is vertically adjustably mounted on machine frame 3 and is arranged for guidance along the respective rail in a vertical and lateral direction. At least one metal removing tool is carried by each tool carrier.

The illustrated means for vertically adjustably mounting each tool carrier on machine frame 3 comprises at least two fluid-pressure operated jacks 19, which are preferably operated by pneumatic pressure to adjust the tool carriers vertically and to bias the tool carriers under the fluid pressure against the respective rails. Universal joints connect the jacks to the machine frame and to the tool carriers. Such a mounting for tool carriers assures a substantially constant, definable load on the tool carriers in tangent and curved track sections without in any way interfering with the free movement of the tool carriers in relation to their associated rails and their clearance-free guidance therealong.

The first set 15 includes a pair of tool carriers 18 each carrying metal cutting tools 28 engageable with running face 36 of rail heads 38. Two flanged wheels 20 at respective ends of tool carriers 18 mount the tool carriers substantially without play with respect to running surface 36 and inside face 37 of the rail heads. The flanged wheels are mounted on the free ends of pivotal arms 21 for adjusting the height of the wheels, a stop 22 cooperating with the pivotal arms to maintain them in a selected annular position. Connecting rod 23 links the rear end of each tool carrier 18 to journal box 24 of front undercarriage 2 so that the tool carriers advance along the track with the machine. A succession of three cutter heads 26 are mounted on each tool carrier and each cutter head carries four detachably mounted cutting tools 28 shaped like planing knives. As shown in FIG. 6, cutting edges 29 of the cutting tools are arranged to engage the running faces of the rail head and extend substantially parallel to base plane 30 of rail base 31, preferably at an acute angle in relation to a plane perpendicular to the track.

The second set 16 includes two pairs of tool carriers 32 each carrying metal grinding tools 33 arranged to be pressed against running faces 36 and preferably against a portion of lateral inside faces 37 of rail heads 38, as shown by cross section 39 of the grinding tools in FIG. 6. Tool carriers 32 also have two flanged wheels 20 mounted on pivotal arms 21 in the same manner as tool carriers 18. A succession of three grinding tools are mounted on each carrier 32, each grinding tool 33 being comprises of holder 34 for whetstone 35 mounted detachably in the holder. The whetstones are designed to smooth the running and lateral inside faces of the rail heads after cutting tools 28 have removed surface irregularities, such as corrugations and the like from the running faces of the rail heads. Profile 39 of the grinding tools may take any shape to obtain the desired shaping of the rail head, such as disclosed, for example, in U.S. Pat. No. 4,050,196.

Crank drive means illustrated as common drive 40 is connected to the pairs of tool carriers 32 of second set 16 and imparts there to reciprocatory working movements in opposite directions along the rails, as indicated by arrows 41. The common crank drive is comprised of crankshaft 43 mounted on machine frame 3 and rotated by motor 42, the crankshaft being connected to two rocking levers 45 associated with each rail for rocking the levers back and forth, a respective push rod 46 connecting each of the tool carriers to one of the rocking levers to produce the reciprocatory working movements of tool carriers 32.

The third set 17 includes a pair of tool carriers 47 and metal shearing tools 53 carried by the tool carriers for engagement with lateral outside faces or field sides 65 of the rail heads, and this set constitutes the subject matter of the invention. At least one longitudinally adjustable spacing member 25 extends transversely to track 12 between tool carriers 18, 32 and 47 of each pair. A pivot connects respective ends of spacing members 25 to the respective tool carriers for free movement of the tool carriers with respect to the spacing members along the rails with which they are associated. This arrangement permits the simultaneous or selective use of cutting, grinding and shearing tools in the shaping and smoothing of rail heads as the machine advances along the track, particularly the successively coarse and fine machining of rail head surfaces with the use of the cutting and shearing tools in a first pass in the direction of arrow 13 and the subsequent smoothing of the machined rail head surfaces with the grinding tools in a reverse pass in the direction of arrow 14. This operation is very economical because the speed best suited to the respective work can be maintained during each pass of the machine along the track section and high working speeds may be obtained while protecting the operating life of the metal removing tools to the utmost. Equipping the machine with the third set providing metal shearing tools makes it possible to meet the requirement of some railroads for not only removing surface irregularities from the rail heads due to wear but also to remove the bulges or overflow metal created at the lateral outside faces of the rail heads by the wheels of the trains rolling over the rails. This is particularly advantageous if previously laid rails are re-used because when such rails are re-laid at opposite sides of the track, they will thus have a machined surface in contact with the flanged train wheels.

As more clearly shown in FIG. 3, pairs of flangeless guide rollers 49, 51 on tool carriers 47 of third set 17 respectively engage running faces 36 and lateral outside faces 65 of rail heads 38 for clearance-free guidance of the tool carriers along rails 10 and 11. Guide rollers 49 are rotatable about horizontal axles 48 extending transversely to the track and guide rollers 51 are rotatable about vertical axles 50. Connecting rod 52 links the forward end of each tool carrier 47 to the journal box of rear undercarriage 2 so that the tool carriers advance with the machine.

Spacing members 25 include adjustment drives for longitudinally adjusting the spacing members, the illustrated adjustment drives being fluid-pressure operated jacks. The adjustment drives for the spacing members between tool carriers 18 and 32 are operable in one direction, i.e., fluid pressure is applied to the jacks so as to press flanged wheels 20 against inside faces 37 of the rail heads, while the adjustment drives for the spacing members between tool carriers 47 are operable in the opposite direction, i.e., fluid pressure is applied to the jacks so as to press guide rollers 51 against outside faces 65 of the rail heads (see FIG. 3) while fluid pressure applied to jacks 19 presses guide rollers 49 against running faces 36.

As shown in FIG. 1, second set 16 of tamping tool carriers 32 is mounted on machine frame 3 between under carriages 2 while the pairs of tool carriers 18 and 47 of the first and third sets 15 and 17 are mounted on end portions of the machine frame overhanging the undercarriages.

The above-described arrangement of the adjustment drives constitutes power-activated means providing a clearance-free guidance of tool carriers 47 along the rails, regardless of the track gauge and changes therein. Care must be taken that guide rollers 51 are arranged so that they press against the lower portions of outside faces 65 which are not deformed so as to assure an accurate reference for shearing tools 53 and to avoid the possibility that these tools are so positioned as to copy the existing bulges or overflow metal created by the cold deformation of the rail heads by the wheels of passing trains. The illustrated arrangement of the three successive sets 15, 16 and 17 of different metal removing tools makes full and space-saving use of all the room available below the machine frame, thus reducing the length of the machine. At the same time, all the tool carriers are independently guided along the rails and move only slightly relative to machine frame 3, even in sharp curves. This produces very favorable conditions for transmitting drive, load, tensile and pressure forces from the machine frame to the tool carriers.

As best shown in FIG. 4, tool carriers 47 of third set 17 carry two metal shearing tools 53 spaced from each other in the direction of the rails, each shearing knife 53 being detachably and adjustably mounted on holders 55 by a pair of set screws 54. In this manner, the shearing tools are adjustable for different cutting depths with respect to the rails, their cutting edges 56 extending substantially parallel to vertical plane of symmetry 57 of the rails, as shown in FIG. 6 and the shearing tools themselves extending obliquely relative to a plane defined by the track and enclosing an acute angle therewith. Distributing the shearing forces over more than one tool not only increases the operating life of the shearing tools but also improves the quality of shearing.

As illustrated in FIG. 5, in a preferred embodiment, spacing members 25 for tool carriers 47 each comprises housing 58 extending transversely to track 12 and connecting rod 62 axially movably and pivotally mounted in the housing. Housing 58 is pivotally connected to one of the tool carriers at pivot 59 to enable the housing to pivot about vertical axis 60 and rod 62 is pivotally connected to the other tool carrier in the same manner. Self-aligning bearing means consisting of pivotal bearings 61 pivotally guide and support connecting rod 62 in housing 58. The adjustment drive for the spacing members comprises cylinder 63 and a piston rod slidable therein, the cylinder being linked to the housing and the piston rod being linked to the connecting rod. By supplying pressure fluid to the piston in the direction of arrow 64, guide rollers 51 are moved into clearance-free engagement with outside face 65 rails 10 and 11, as shown in FIG. 3.

In this arrangement, the spacing member constitutes the guide part for the longitudinally adjustable spacing of the two opposite tool carriers while the adjustment drive does not have to absorb any of the guide forces. The pivotal mounting of connecting rod 62 in housing 58 of the spacing member makes it possible for the spacing member to be tilted so that the two opposite tool carriers may be positionally adjusted in track superelevations where one rail is higher than the other.

FIG. 6 shows an end view of a conventional rail in new condition, in full lines. As the rail becomes progressively worn by a succession of trains rolling thereover, the rail head is deformed in a manner generally indicated by the broken lines indication depressions, corrugations or like surface irregularities in running face 36 and bulges 66 and 67 at the lateral faces 37 and 65 of rail head 38. All of these surface irregularities are removed by operation of the three sets of metal removing tools provided on the machine, as hereinabove described.

At the beginning of the operation, the track section is first subjected to coarse machining. For this purpose, jacks 19 are actuated to lower tool carriers 18 and 47, and the adjustment drives are actuated to adjust spacing members 25 longitudinally until flanged wheels 20 and guide rollers 49, 51 are in clearance-free engagement with rails 10 and 11. After the cutting depth of tools 28 and 53 has been suitably adjusted, fluid pressure is applied to jacks 19 until a desired vertical pressure has been applied to the tool carriers to press the tools into engagement with the rail heads.

With tools 28 and 53 thus in working position and with tool carriers 32 remaining in their raised or inoperative position, drive 9 is actuated to advance machine 1 continuously along track 12 in the direction of arrow 13 at a speed of about 4 to 6 km/h. During this pass, undulations and other irregularities are coarsely removed from running face 36 of rail heads 38 by cutting tools 28 while shearing knives 53 simultaneously remove bulges 66 from lateral outside faces 65. At the end of the track section on which work is to be done, machine 1 is stopped, the adjustment drives are actuated to disengage the flanges wheels and guide rollers from the rails and jacks 19 are actuated to raise the tool carriers to their inoperative positions. Tool carriers 32 are now lowered and their flanged wheels are brought into engagement with the rails. With the grinding tools pressed against the rail heads, motor 42 is actuated to impart reciprocatory movements to the tool carriers while the operating direction of machine 1 is reversed (see arrow 14), the machine being advanced at a reduced speed of about 1 km/h to grind the rail head faces smooth, the grinding stones with their profiles 39 also removing at least part of bulges 67 on the inside face of the rail heads.

If desired, this smoothing operation may be followed by a subsequent grinding pass to increase the smoothness of the rail head surfaces, the entire operation being very effective in producing high-quality surfacing of the rail heads while assuring a most economical production. If desired, all three sets of metal removing tools may be operated at the same time in a single operating pass while each set may be operated singly, if conditions warrant.

What is claimed is:

1. A mobile machine mounted on a track for advancement therealong, the track comprising two rails each including a head having a running face, a lateral inside face and a lateral outside face, for removing surface irregularities from the faces of the rail heads, which comprises (a) a machine frame, (b) a pair of vertically adjustable tool carriers transversely aligned with respect to the track, a respective one of the tool carriers being associated with a respective one of the rails, (1) each tool carrier carrying a metal shearing tool engaging with the lateral outside face of the rail head of the respective rail, and (2) guide rollers respectively engaging the running faces and lateral outside faces of the rail heads for guiding each tool carrier along the respective rail, (c) a longitudinally adjustable spacing member extending transversely to the track between the tool carriers and a pivot connecting respective ends of the spacing member to a respective one of the tool carriers, and (d) power-actuated means for pressing the guide rollers against the rail head faces they engage for guiding each tool carrier clearance-free along the rails, the power-actuated means including a drive for adjusting the length of the spacing member.

2. The mobile machine of claim 1, wherein the guide rollers engaging the lateral outside faces of the rail heads engage the same at lower portions thereof and the power-actuated means are hydraulic drive means.

3. The mobile machine of claim 1, wherein each tool carrier carries two metal shearing tools spaced from each other in the direction of track elongation, the shearing tools being adjustable for different cutting depths with respect to the lateral outside face.

* * * * *